United States Patent [19]

Menjo et al.

[11] Patent Number: 5,049,943

[45] Date of Patent: Sep. 17, 1991

[54] FIXING ROTATING MEMBER COATED WITH AN ELASTIC LAYER AND AN OFFSET PREVENTION LAYER WITH A PREDETERMINED OIL ABSORPTION RATE

[75] Inventors: Takeshi Menjo, Tokyo; Masaaki Sakurai, Yokohama; Tatsuo Takeuchi; Yasuo Nami, both of Kawasaki, all of Japan

[73] Assignee: Canon Kabushiki Kaisha, Tokyo, Japan

[21] Appl. No.: 524,074

[22] Filed: May 16, 1990

[30] Foreign Application Priority Data

May 24, 1989 [JP] Japan ..... 1-128969

[51] Int. Cl.[5] ..... G03G 15/20; G03G 21/00

[52] U.S. Cl. ..... 355/284; 118/60; 355/282

[58] Field of Search ..... 355/284, 282; 118/60; 430/99; 428/380

[56] References Cited

U.S. PATENT DOCUMENTS

| | | | |
|---|---|---|---|
| 4,074,001 | 2/1978 | Imai et al. | 118/60 X |
| 4,079,229 | 3/1978 | Takiguchi | 219/216 |
| 4,145,599 | 3/1979 | Sakurai et al. | 219/216 |
| 4,147,832 | 4/1979 | Namiki | 428/380 X |
| 4,360,566 | 11/1982 | Shimizu et al. | 118/60 X |
| 4,533,231 | 8/1985 | Shigenobu | 118/60 X |
| 4,562,335 | 12/1985 | Katsuno et al. | 219/216 |
| 4,568,275 | 2/1986 | Sakurai | 432/60 |
| 4,580,033 | 4/1986 | Sakurai | 219/216 |
| 4,595,274 | 6/1986 | Sakurai | 355/290 |
| 4,640,600 | 2/1987 | Hirabayashi et al. | 355/290 |
| 4,763,158 | 8/1988 | Schlueter, Jr. | 355/284 |
| 4,796,046 | 1/1989 | Suzuki et al. | 355/284 |

FOREIGN PATENT DOCUMENTS

| | | |
|---|---|---|
| 54-41332 | 12/1979 | Japan . |
| 57-46068 | 10/1982 | Japan . |
| 60-21860 | 5/1985 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A fixing device includes a fixing rotating member for grasping and conveying a recording material supporting an unfixed image, and a coating means for coating release oil on the fixing rotating member.

The rotating member includes an elastic layer and an offset prevention layer provided on the elastic layer.

An oil absorption rate of the elastic layer for the oil is 5–20 wt %, and an oil absorption rate of the offset prevention layer for the oil is 30–150 wt %.

10 Claims, 3 Drawing Sheets

FIXING ROTATING MEMBER COATED WITH AN ELASTIC LAYER AND AN OFFSET PREVENTION LAYER WITH A PREDETERMINED OIL ABSORPTION RATE

BACKGROUND OF THE INVENTION

1. Field of the Invention

This invention relates to a fixing device for fixing an unfixed image on a recording material, and more particularly, to a fixing device using release oil in order to prevent offset.

2. Description of the Related Art

In an image forming apparatus, an unfixed toner image formed on a recording material is fixed by a fixing device provided within the apparatus.

The image fixing device grasps the recording material carrying the unfixed toner image by a rotating member for fixing, that is, a fixing member usually having the shape of a roller, and a pressurizing roller facing it, and fixes the toner image on the recording material.

Since such a fixing roller needs to have a degree of releasability, it has widely been practiced to coat the roller with a suitable release agent such as silicone oil.

Furthermore, it is desirable that the fixing roller have high elasticity in order to increase its fixability.

However, a material which is superior in both elasticity and releasability has not been found. Accordingly, it has been considered to provide the fixing roller with necessary functions by providing a double-layer structure in which an elastic layer made of rubber having an excellent elasticity is disposed as a lower layer and an offset prevention layer made of rubber having an excellent releasability is disposed as an upper layer.

It has been found, however, that, even if a roller having such a double-layer structure is used with a silicone oil coated thereon, there arise the following problems. That is, the releasability of the offset prevention layer does not last long, but decreases within a short period, and offset occurs after only a relatively small number of recording-material sheets are passed. Hence, the roller has a short life.

The inventors of the present invention have studied the causes of the problems and found the following facts. Since the oil absorption rate of the offset prevention layer, that is, the upper layer, is low, very little oil penetrates into the offset prevention layer even if silicone oil is coated in order to increase the releasability of the layer. Moreover, since the amount of oil absorbed in the offset prevention layer is small, much of the oil applied to the offset prevention layer is taken away by the recording material during the passage of the recording material, and the oil is rapidly exhausted. As a result, the releasing function by silicone oil disappears, and offset thereby occurs. That is, a superior releasability of the fixing roller can be obtained by a synergistic effect produced by an oil barrier formed on the surface of the offset prevention layer by an exuding effect of silicone oil from within the offset prevention layer, and by oil coated on the surface of the offset prevention layer from the outside.

In the case of using the fixing roller having the double-layer structure, the elastic layer, i.e., the lower layer, is made of oil-resistant (nonswelling) rubber which does not absorb oil, for example, fluorosilicone rubber, fluororubber, or rubber made by mixing these rubber materials with other rubber materials, such as dimethylsilicone rubber and the like, in order to prevent permeation of the oil from the offset prevention layer, i.e., the upper layer, and the swelling of the elastic layer due to the oil, as disclosed in Japanese Patent Publication Nos. 54-41332 (1979), 57-46068 (1982), and 60-21860 (1985).

Although it is possible to prevent the permeation of the oil from the offset prevention layer by using such an elastic layer, there is a problem in that the oil accumulates in the interface between the elastic layer and the offset prevention layer, and the offset prevention layer is apt easily to peel off the elastic layer. In order to solve this problem, it is intended to increase the adhesion strength between the two layers. There is a limit, however, in the increase of the adhesion strength, and hence the problem of the peeling of the offset prevention layer has not been solved yet.

SUMMARY OF THE INVENTION

It is an object of the present invention to provide a fixing device having a rotating member for fixing which is superior in both releasability and elasticity.

It is another object of the present invention to provide a fixing device having a rotating member for fixing, in which an offset prevention layer does not peel from an elastic layer even if release oil is coated on the offset prevention layer.

It is still another object of the present invention to provide a fixing device having a rotating member for fixing in which an oil absorption rate of an elastic layer is 5–10 wt % and an oil absorption rate of an offset prevention layer is 30–150 wt %.

These and other objects and features of the present invention will become more apparent from the following description.

DESCRIPTION OF THE PREFERRED EMBODIMENTS

The preferred embodiment of the present invention will now be described in detail.

First, an explanation will be provided of an image forming apparatus having a fixing device according to the preferred embodiment of the present invention.

Figure 1:
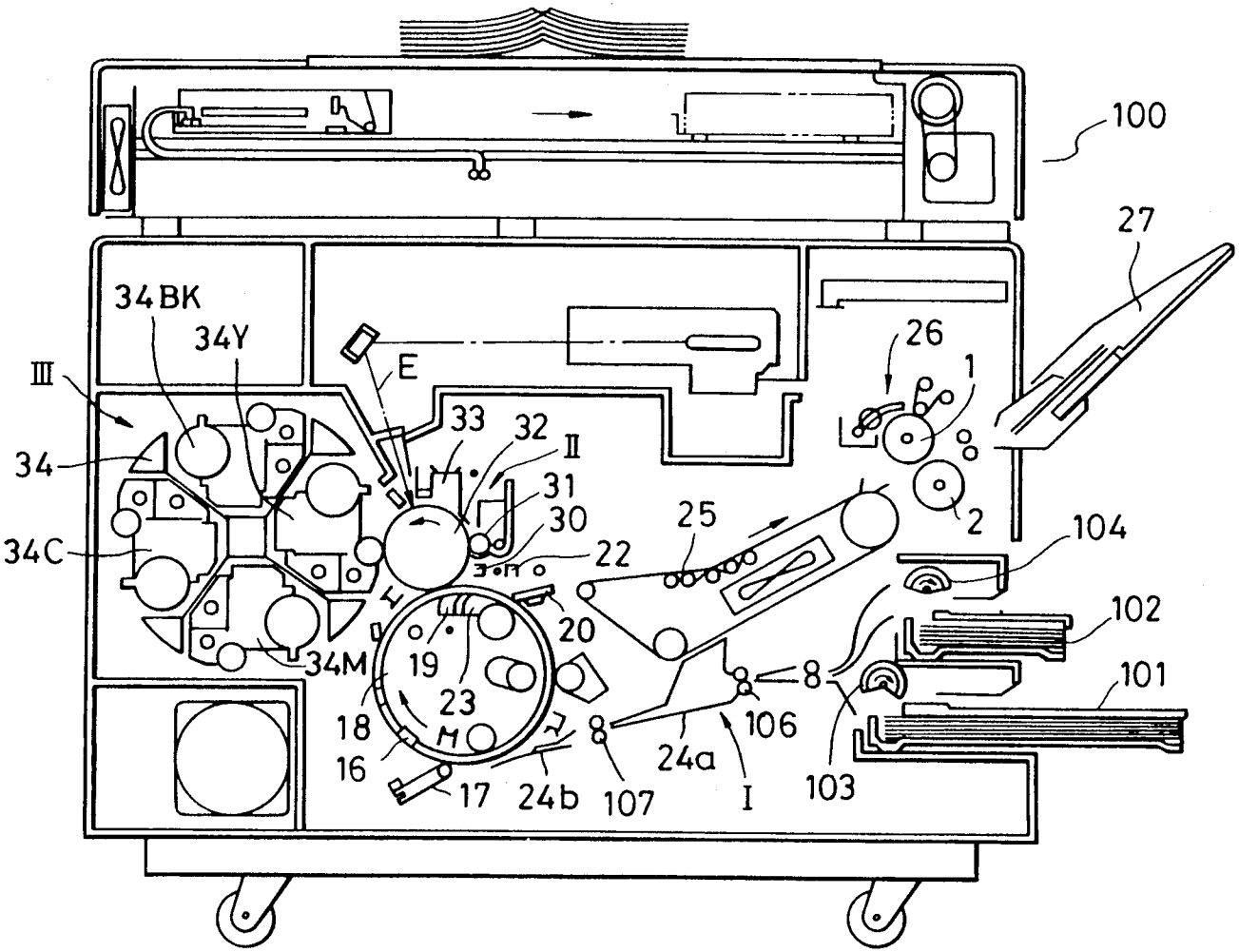
FIG. 1 is a diagram showing the configuration of an image forming apparatus having an image fixing device according to an embodiment of the present invention.

FIG. 1 is a diagram showing the configuration of an embodiment of an electrophotographic image forming apparatus which can form a full-color image made by mixing toners having different colors, and which is provided with a fixing device according the preferred embodiment of the present invention.

As shown in FIG. 1, the present image forming apparatus is basically configured by a transfer material conveying system I provided from one side (the right side in FIG. 1) of a main body 100 of the apparatus over a nearly central portion of the main body 100, a latent image forming unit II provided close to a transfer drum 18 rotatable in the direction of the arrow, and a developing means, that is, a rotating developing device III disposed close to the latent image forming unit II at another side of the main body 100 of the apparatus.

The transfer material conveying system I includes trays 101 and 102 for supplying transfer materials and detachable relative to an opening formed at one side (the right side in FIG. 1) of the main body 100 of the apparatus, rollers 103 and 104 for feeding paper, disposed almost immediately above these trays 101 and 102, a paper feeding guide 24*a* provided with paper feeding rollers 106 and 107 at both its ends, disposed close to the rollers 103 and 104 and a paper feeding guide 24*b* succeding the paper feeding guide 24*a*. The system I also includes a roller 17 for contacting the transfer material, a gripper 16, a charger 22 for separating the transfer material, and a separation pawl 20, sequentially provided from a lower end portion to an upper end portion in the direction of rotation around a transfer drum 18, a transfer charger 19 and a charger 23 for separating the transfer material disposed inside the transfer drum 18, a conveying belt means 25 provided close to the separation pawl 20 at a position above the paper feeding guide 24*a*, a tray 27 for receiving discharged transfer material, detachable relative to the main body 100 of the apparatus and extended outside the main body 100 of the apparatus on the extension of the end portion in the direction of conveyance of the means 25, and an image fixing device 26 according to the present invention, disposed between the conveying belt means 25 and the discharge tray 27.

The latent image forming unit II includes an image carrying member, that is, a photosensitive drum 32 rotatable in the direction of the arrow, disposed in contact with the transfer drum 18 above a nearly upper end thereof, a charger 30 for removing electric charges, cleaning means 31 and a primary charger 33 provided around the circumference of the drum 32 from a side end to an upper end thereof in the direction of rotation, an image exposure means, such as a laser beam, for forming an electrostatic latent image on the outer circumferential surface of the photosensitive drum 32, and a beam deflection means, such as a polygon mirror.

The rotating developing device III includes a rotating member 34 consisting of a rotatable box member, and a yellow developing unit 34Y, a magenta developing unit 34M, a cyan developing unit 34C and a black developing unit 34BK mounted on the rotating member 34 and configured so as to visualize, that is, to develop the electrostatic latent image at a position facing the outer circumferential surface of the photosensitive drum 32.

The sequence of the operation of the entire image forming apparatus having the above-described configuration will now be briefly explained illustrating the case of a full-color mode.

That is, the photosensitive drum 32 rotates in the direction of the arrow shown in FIG. 1, and a photosensitive layer on the drum 32 is uniformly charged by the primary charger 33. An image is then exposed by laser light E modulated by a yellow image on an original, and an electrostatic latent image of the yellow image is formed on the photosensitive drum 32. The electrostatic latent image of the yellow image is developed by the yellow developing unit 34Y previously positioned at a developing position by the rotation of the rotating member 34 of the developing device III.

On the other hand, the transfer material (not shown) conveyed through the paper feeding guide 24*a*, the paper feeding roller 106 and the paper feeding guide 24*b* is held by the gripper 16 with a predetermined timing, and is electrostatically wound around the transfer drum 18 by the contact roller 17 and an electrode facing it. The tranfer drum 18 rotates in the direction of the arrow shown in FIG. 1 in synchronization with the photosensitive drum 32, and a visualized image developed by the yellow developing unit 34Y is transferred by the transfer charger 19 at a portion where the outer circumferential surface of the photosensitive drum 32 contacts the outer circumferential surface of the transfer drum 18. The tranfer drum 18 continues its rotation, and provides for the tranfer of the subsequent color (magenta in FIG. 1).

On the other hand, electric charges on the photosensitive drum 32 are removed by the charger 30, and the cleaning means 31 cleans the photosensitive drum 32, which is then charged again by the primary charger 33, and is subjected to image exposure as described above by the subsequent magenta image signal. While an electrostatic latent image by the magenta image signal is being formed on the photosensitive drum 32 by the above-described image exposure, the developing device III rotates to position the magenta developing unit 34M at the developing position, where a predetermined magenta development operation is performed. Subsequently, the above-described process is performed for a cyan color and a black color, respectively. After the transfer of the image having four colors has been completed, electric charges of the four-color visual image formed on the transfer material are removed by the chargers 22 and 23, and the grasping of the transfer material by the gripper 16 is released. The transfer material is then separated from the transfer drum 18 by the separation pawl 24, and is conveyed to the image fixing device 26 by the conveying belt means 25. The four-color image on the transfer material is mixed and fixed by heat and pressure in the fixing device 26. The sequence of a series of full-color printing operations is thus terminated, and a necessary full-color print image is formed.

Next, a developer used in the present image forming apparatus will be explained.

Color toner used in a color image forming apparatus must have excellent fusing and color-mixing properties when heat is applied, and it is preferred to use sharp-melt-type toner which has a low softening point and a short fusing time. That is, by using such sharp-melt-type toner, it is possible to expand the color reproducing range of a copy, and hence to obtain a color copy which reproduces the image of an original with fidelity.

Such sharp-melt-type toner is produced by fusing, kneading, pulverizing and classifying, for example, styreneacrylic resin, coloring agents (dyes and sublimation dyes), charge controlling agents and the like. If necessary, various kinds of external additives may be added to the toner.

In consideration of the offset-resistant property, fixability and sharp-melt property of color toner, it is particularly preferred to use sharp-melt-type polyester resin as a binding resin. The sharp-melt-type polyester resin is a high molecular compound having ester bonds in principal chains of molecules synthesized from a diol compound and dicarboxylic acid. For the sharp-melt-type color toner used in the present image forming apparatus, the softening point of sharp-melt-type polyester resin may be 60°-150° C., and more preferably, 80°-120° C.

Figure 2:
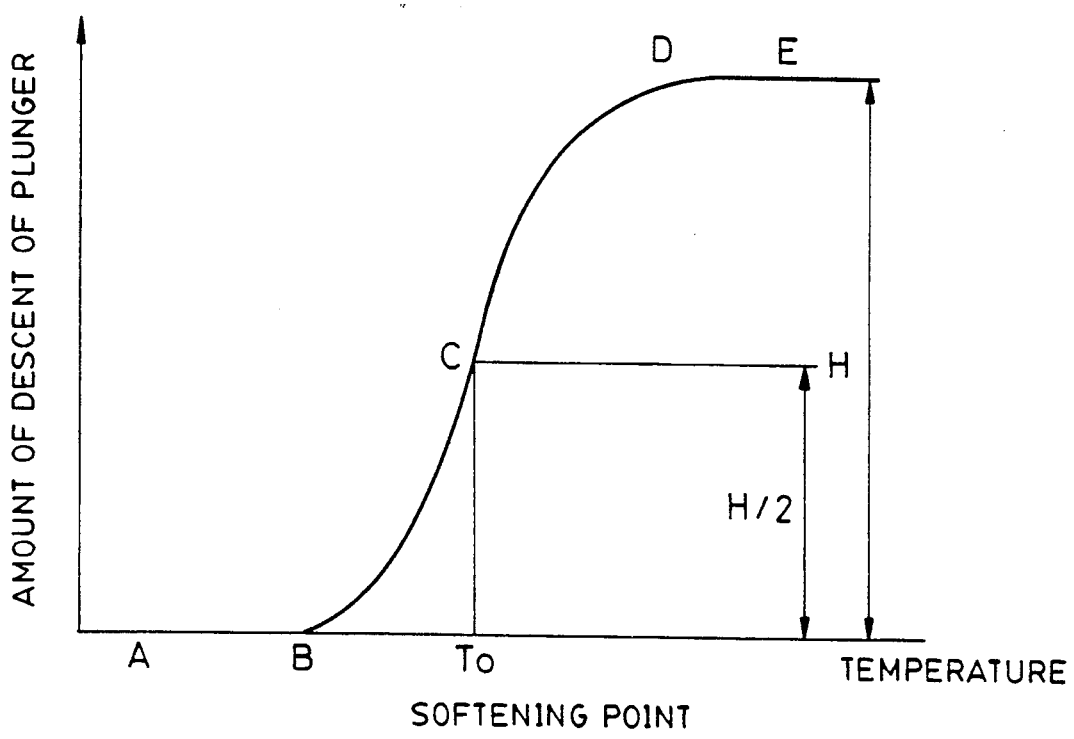
FIG. 2 is a graph showing a softening property of sharp-melt-type color toner used in the image forming apparatus shown in FIG. 1.

The softening property of the sharp-melt-type color toner used in the FIG. 1 apparatus is shown in FIG. 2.

FIG. 2 shows a curve of the amount of the descent of a plunger vs temperature (termed hereinafter a softening S-like curve) depicted when a flow tester CFT-500 (made by Shimadzu Corporation) was used, 50 kg load was applied with a die (nozzle) having a diameter of 0.5 mm and a thickness of 1.0 mm, and temperature was raised at a constant speed of 5° C./min. after a preheating time of 300 seconds at an initial setting temperature of 80° C. 1–3 g of refined fine-particle color toner was used as the sample, and a plunger having a cross section of 1.0 $cm^2$ was used.

The softening S-like curve for the color toner becomes a curve as shown in FIG. 2. That is, in accordance with the rise of temperature at a constant speed, the toner is gradually heated, and effusion starts (the descent of the plunger A→B). When temperature is further raised, the toner in a fused state largely effuses (B→C→D), and the descent of the plunger stops (D→E).

The height of the S-like curve indicates the total amount of effusion, and the temperature $T_0$ corresponding to point C having the height of H/2 indicates the softening point of the toner.

The sharp-melt-type resin providing such color toner is a resin which satisfies the conditions of $T_1=90°-150°$ C. and $|\Delta T|=|T_1-T_2|=5°-30°$ C., where $T_1$ is a temperature when the fused viscosity is $10^5$ cp (centipoises), and $T_2$ is a temperature when the fused viscosity is $5\times10^4$ cp.

The sharp-melt-type resin having the temperature-fused viscosity characteristic as described above is characterized in that its viscosity very sharply decreases by being heated. This decrease in viscosity causes an appropriate mixture of the uppermost toner layer and the lowermost toner layer of color toner made of sharp-melt-type resin, abruptly increases the transparency of the toner layers, and causes excellent color-mixing by color-subtraction.

Such sharp-melt-type toner has large affinity so as to be easily mixed, and is easily subjected to offset to the fixing roller.

Accordingly, the fixing device in the present embodiment is provided with a very large degree of releasability.

The fixing device of the present invention will now be explained.

Figure 3:
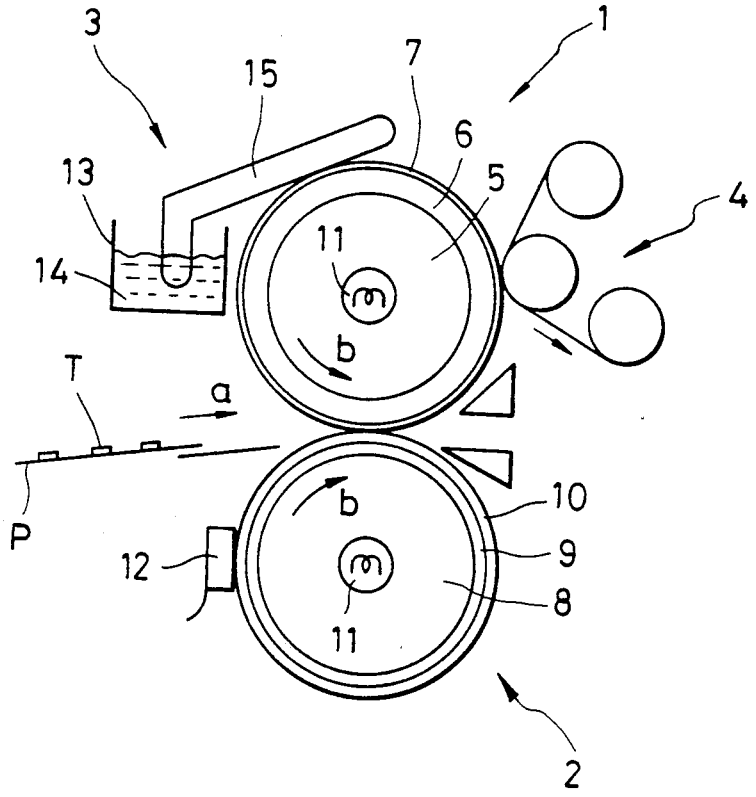
FIG. 3 is an enlarged cross-sectional view showing an embodiment of the image fixing device of the present invention.

FIG. 3 is an enlarged cross-sectional view of the fixing device 26 used in the FIG. 1 apparatus.

As shown in FIG. 3, the image fixing device 26 includes a rotating member for fixing, that is, a fixing roller 1, a pressurizing roller 2 in pressure contact with it, a release-agent coating means 3 for coating silicone oil, serving as a release agent, on the fixing roller 1, and cleaning means 4 for cleaning the fixing roller 1.

The fixing roller 1 is formed of an aluminum core bar 5, serving as the base material of the roller, an elastic layer 6 made of phenyl HTV silicone rubber (high-temperature-vulcanization-type silicone rubber) having high elasticity and high heat-conductive property formed thereon, and an offset prevention layer 7 made of RTV silicone rubber (room-temperature-vulcanization-type silicone rubber) formed on the elastic layer 6, and has, for example, an outer diameter of 40 mm.

In the present embodiment, since the offset of the sharp-melt-type toner cannot be prevented by the releasability of the offset prevention layer alone, a large amount of silicone oil is coated by the above-described release-agent coating means 3.

The offset prevention layer is made of rubber so as to maintain the elasticity of the roller for satisfactorily mixing colors of the multilayered toner. In addition, silicone rubber having excellent wettability for silicone oil, in particular, RTV silicone rubber having excellent releasability is used so that silicone oil can be sufficiently coated.

The pressurizing roller 2 is formed by an aluminum core bar 8, an elastic layer 9, 1 mm thick, made of HTV silicone rubber formed thereon, and a resin layer 10 made of fluororesin formed on the elastic layer 9, and similarly has, for example, an outer diameter of 40 mm.

Halogen-lamp heaters 11 are disposed within the core bar 5 of the fixing roller 1 and the core bar 8 of the pressurizing roller 2, respectively. The temperature of the pressurizing roller 2 is detected by a thermistor 12 in contact with it, and the on-off control of the halogen-lamp heater 11 is performed so that the temperatures of the fixing roller 1 and the pressurizing roller 2 are maintained at a constant value of about 170° C.

In the present embodiment, since a large amount of silicone oil is coated on the fixing roller 1, if the thermistor 12 contacted the fixing roller 1, the oil would be scraped off from the contact portion, and oil stripes would appear in a fixed image.

Consequently, the temperature of the surface of the pressurizing roller 2, which does not contact an undeveloped image, is detected, and the halogen-lamp heater 11 within the fixing roller 1 is subjected to on-off control according to the detected information.

The releasing-agent coating means 3 coats silicone oil 14 having a viscosity of 300 CS housed within a receptacle 13 on the offset prevention layer 7 of the fixing roller 1 by a felt 15.

The cleaning means 4 removes the toner attached by offset to the offset prevention layer 7 of the fixing roller 1.

The fixing device 7 as described above, by conveying a recording material P carrying an unfixed toner image T in the direction of arrow "a" by a conveying device (not shown), and by supplying the recording material P with heat and pressure by passing it between the fixing roller 1 and the pressurizing roller 2 while grasping the recording material P by the fixing roller 1 and the pressurizing roller 2 rotated in the direction of arrow "b" by a driving device (not shown), the toner image T is fixed by heat onto the recording material P.

In the present invention, in order to increase the releasability of the offset prevention layer and to prevent silicone oil from accumulating at the interface between the elastic layer 6 and the offset prevention layer 7 thereon, the offset prevention layer 7 is formed so that its oil absorption rate becomes 30–150 wt % in order to sufficiently hold the silicone oil. Furthermore, the elastic layer 6 is not provided with a complete oil-resistant property, but is formed so that its oil absorption rate becomes 5–20 wt % in order to more or less absorb the oil at the interface.

The oil absorption rate of rubber is obtained as follows.

That is, dimethyl silicone oil 100 CS (for example, KF96 100 CS made by Shin-Etsu Chemical Co., Ltd.) is heated at 180° C., a rubber piece is immersed therein, and the weight D(g) of the rubber piece before the immersion and the weight E(g) after the immersion for 8 hours are measured to obtain the oil absorption rate $(\%)=(E-D)/D\times 100$.

If the oil absorption rate of the elastic layer 6 is less than 5 wt %, since the elastic layer 6 hardly absorbs the silicone oil from the offset prevention layer 7, it is impossible to prevent the oil from accumulating at the interface between the elastic layer 6 and the offset prevention layer 7, and hence to prevent the offset prevention layer from peeling. On the other hand, if the oil absorption rate exceeds 20 wt %, the amount of silicone oil absorbed from the offset prevention layer 7 becomes large, and creases occur in the passing recording material P due to deformation of the fixing roller 1 caused by the swelling of the elastic layer 6.

If the oil absorption rate of the offset prevention layer 7 is less than 30 wt %, since it is impossible to increase the amount of the oil absorbed in the prevention layer 7, the releasability of the offset prevention layer 7 is not sufficiently increased, and it is therefore impossible to prevent offset. On the other hand, if the oil absorption rate exceeds 150 wt %, the amount of the oil absorbed in the offset prevention layer 7 becomes too large, and the strength of the rubber decreases due to the large amount of oil. Hence, the destruction of the rubber of the offset prevention layer 7 occurs.

In order to set the oil absorption rate of the elastic layer 6 to 5–20 wt %, one approach is to adjust the content of phenyl radicals in phenyl HTV silicone rubber constituting the elastic layer 6 to, for example, 5–50 mol %, more preferably, 10–30 mol %. By another approach, it is possible to set the oil absorption rate of the elastic layer 6 made of phenyl HTV silicone rubber to 10 wt % by adjusting the cross-linking density of the silicone rubber, and the amount of filler and the like to be mixed within the silicone rubber.

In order to increase the heat-resistant property and thermal conductivity of the elastic layer 6, filler, such as silica, cerium and the like, is mixed in the elastic layer 6. In particular, the thermal conductivity of the filler is set to $0.5\times 10^{-3}$ cal/cm.sec.°C. It is preferred to set the thermal conductivity to about $1.0\times 10^{-3}$ cal/cm.sec.°C.

The elastic layer 6 may be formed by phenyl or methyl LTV silicone rubber, a normal HTV silicone rubber or the like. However, from the viewpoint of having excellent tensile strength, adhesive property relative to the core bar 5, thermal conductivity and modulus of elasticity, it is preferred to form the elastic layer 6 by phenyl HTV silicone rubber, as described above.

If HTV silicone rubber having an excellent heat-conductive property is used for the elastic layer 6, heat is rapidly supplied from the core bar 5 to the surface of the fixing roller 1. Hence, even if heat dissipation by the passage the recording material P is large, the surface temperature of the fixing roller 1 is maintained constant, and a thermally stable fixing operation becomes possible. Particularly in the fixing of a color image, the surface temperature of the fixing roller 1 greatly influences color mixture, that is, a change in the surface temperature influences the color image by changing the hue of the image. Accordingly, it is suitable to form the elastic layer 6 by HTV silicone rubber having an excellent heat-conductive property.

LTV silicone rubber (low-temperature-vulcanization-type silicone rubber) may also be used for the offset prevention layer 7 in place of RTV silicone rubber used in the present embodiment, since it has an excellent oil absorption property relative to silicone oil. However, RTV silicone rubber is more suitable because it also has excellent releasability.

Although there are two types, that is, single-liquid-type and two-liquid-type, of RTV silicone rubber, single-liquid-type RTV silicone rubber is particularly preferred for the following reasons. That is, single-liquid-type RTV silicone rubber has an adhesive property relative to a substance to which it is to adhere before vulcanization, and firmly adheres to the elastic layer 6 by chemical bond at the final stage. Hence, if single-liquid-type silicone rubber is used, it becomes unnecessary to particularly provide a primer layer for adhesion.

In order to set the oil absorption rate of the offset prevention layer 7 to 30–150 wt %, single-liquid-type RTV silicone rubber having, for example, a large molecular weight may be used, and its degree of cross-linking and the amount of filler, such as silica and the like, may be properly adjusted. A known method may be used for mixing a proper amount of filler, such as red iron oxide and the like, in the offset prevention layer 7.

By reducing the thickness of the offset prevention layer 7 to 0.4 mm or less, it becomes possible to substantially restrict swelling of the offset prevention layer 7 even if it absorbs silicone oil, and to hardly cause the destruction of rubber molecules in the prevention layer 7. It is thus possible to maintain the surface strength of the fixing roller 1. On the other hand, if the thickness of the offset prevention layer 7 becomes as thin as less than 0.05 mm, it becomes difficult to uniformly cover the entire surface of the elastic layer 6 by the prevention layer 7. Accordingly, it is preferred to define the thickness of the offset prevention layer 7 within the range of 0.05 mm–0.4 mm.

In the image fixing device of the present invention, the oil absorption rate for silicone oil of the offset prevention layer 7 of the fixing roller 1 is set to a high value. Hence, the offset prevention layer 7 efficiently absorbs silicone oil, preventing shortage in the amount of oil absorption and early occurrence of offset. Furthermore, the elastic layer 6, under the offset prevention layer 7, is not perfectly oil-resistant, but absorbs a certain amount of oil. Hence, the elastic layer 6 absorbs silicone oil from the interface between the elastic layer 6 and the offset prevention layer 7, and some silicone oil accumulates at the interface. It is thereby possible to prevent the peeling of the offset prevention layer 7 from the elastic layer 6.

Although an explanation has been provided of a case in which the rotating member for fixing is in fact the fixing roller 1, the present invention is not limited thereto, but the rotating member for fixing may also take the form of a belt.

Next, specific embodiments of the image fixing device of the present invention will be explained in detail.

For the fixing roller 1, the oil absorption rate X of the offset prevention layer 7 for silicone oil was changed within the range of 30–150 wt %, and the oil absorption rate Y of the elastic layer 6 was changed within the range of 5–20 wt %. Five kinds of fixing rollers provided by the combination of various absorption rates for the offset prevention layer 7 and the elastic layer 6 were assembled in the image fixing device shown in FIG. 3. Thus, the image fixing devices of Examples 1–5 were provided. Using these image fixing devices of Examples 1–5, undeveloped toner images on recording paper were fixed.

For the purpose of comparison, eight kinds of fixing rollers in which at least one of the oil absorption rate X of the offset prevention layer 7 and the oil absorption rate Y of the elastic layer 6 was out of the range of the present invention were assembled in the image fixing device shown in FIG. 3 in place of the above-described inventive fixing rollers 1. The image fixing devices of Comparative Examples 1-8 were thus provided, and the fixing operation was performed in the same manner as in Examples 1-5.

The oil absorption rates X of the offset prevention layer 7 and the oil absorption rates Y of the elastic layer 6 in the fixing rollers of the image fixing devices of Examples 1-5 and Comparative Examples 1-8, and the results of the fixing operation for these devices are shown in Table 1.

As shown in Table 1, in Examples 1-5, since the oil absorption rates X of the offset prevention layers 7 of the fixing rollers are high, and the oil absorption rates Y of the elastic layers 7 are also relatively high, for all cases, offset did not occur even in the fixing operation for the 20,000-th sheet or more, and the peeling of the offset prevention layer 7 did not occur either.

TABLE 1

| Item | Oil absorption rate X(wt %) of offset prevention layer | Oil absorption rate Y(wt %) of elastic layer | Result |
|---|---|---|---|
| Example 1 | 54 | 10 | Fixable 20,000 sheets or more |
| Comparative Example 1 | 10 | 10 | Offset occurred at 3,000-th sheet |
| Example 2 | 30 | 5 | Fixable 20,000 sheets or more |
| Example 3 | 30 | 20 | Fixable 20,000 sheets or more |
| Example 4 | 150 | 5 | Fixable 20,000 sheets or more |
| Example 5 | 150 | 20 | Fixable 20,000 sheets or more |
| Comparative Example 2 | 29 | 5 | Offset occurred at 10,000-th sheet |
| Comparative Example 3 | 29 | 20 | Offset occurred at 5,000-th sheet |
| Comparative Example 4 | 151 | 5 | Destruction of rubber in offset prevention layer occurred at 5,000-th sheet |
| Comparative Example 5 | 151 | 20 | Destruction of rubber in offset prevention layer occurred at 5,000-th sheet |
| Comparative Example 6 | 30 | 4 | Peeling of offset prevention layer occurred at 10,000-th sheet |
| Comparative Example 7 | 150 | 4 | Peeling of offset prevention layer occurred at 6,000-th sheet |
| Comparative Example 8 | 150 | 21 | Creases in paper due to deformation of fixing roller occurred at 5,000-th sheet |

In Comparative Examples 1-3, since the oil absorption rate X of the offset prevention layer is low, the oil in the prevention layer 7 becomes shortly exhausted. Accordingly, offset occurred at the fixing operation of the 3,000-th sheet, 10,000-th sheet and 5,000-th sheet in Comparative Examples 1, 2 and 3, respectively. To the contrary, in Comparative Examples 4 and 5, since the oil absorption rate X of the offset prevention layer 7 is too high, the strength of the rubber of the prevention layer 7 decreases. Hence, the destruction of the rubber of the prevention layer 7 occurred at the fixing operation of the 5,000-th sheet.

On the other hand, in Comparative Examples 6 and 7, since the oil absorption rate Y of the elastic layer 6 is low, the oil accumulates at the interface between the elastic layer 6 and the offset prevention layer 7. Accordingly, the peeling of the offset prevention layer 7 occurred at the fixing operation of the 10,000-th sheet and 6,000-th sheet in Comparative Examples 6 and 7, respectively. To the contrary, in Comparative Example 8, since the oil absorption rate Y of the elastic layer 6 is too high, the elastic layer 6 swells because the oil supply amount is large, causing deformation of the fixing roller. Accordingly, creases occurred in the recording paper during the fixing operation at the 10,000-th sheet.

The results for Example 4 and Comparative Example 6 will now be investigated in detail.

The results for Example 4 and Comparative Example 6 will be extracted from Table 1 and redescribed as follows:

EXAMPLE 4 oil absorption rate X (offset prevention layer): 150 wt %, oil absorption rate Y (elastic layer): 5 wt %, result: fixable 20,000 sheets or more.

COMPARATIVE EXAMPLE 6 oil absorption rate X: 30 wt %, oil absorption rate Y: 4 wt %, result: peeling of offset prevention layer occurred at 10,000-th sheet.

Between Comparative Example 6 and Example 4, although there is a big difference of 30 vs 150 wt % in the oil absorption rate X of the offset prevention layer, i.e., the upper layer, the peeling of the offset prevention layer occurred in Comparative Example 6 due to only a difference of 1 wt %, that is, 4 vs 5 wt % in the oil absorption rate Y of the elastic layer, i.e., the lower layer. This is because the oil absorption rate of the offset prevention layer does not represent the actual amount of oil absorbed by the rubber constituting the offset prevention layer.

The inventors of the present invention have previously described the method of measuring the oil absorption rate of rubber. In practice, however, silicone oil is not impregnated at all in the roller, or only a small amount of silicone oil is impregnated, when the fixing roller is formed. The actual supply of the oil for the offset prevention layer is performed by the coating of the oil during the copying operation.

Accordingly, the difference in the amount of oil during use between the fixing rollers of Example 4 and Comparative Example 6 is not great based on the values of 150 wt % and 30 wt % in the case of use for a long period.

On the other hand, the oil absorption rate of the elastic layer, i.e., the lower layer of less than 5 wt % causes the accumulation of oil at the interface between the elastic layer, i.e., the lower layer and the offset prevention layer, i.e., the upper layer, and the peeling of the offset prevention layer.

In other words, the majority of the oil coated on the surface of the fixing roller during the copying operation adheres to the recording paper, but the remaining oil on the surface of the roller gradually penetrates into the roller during a standby state and during periods of non-use.

This penetration phenomenon effectively functions for offset, but is apt to induce a peeling phenomenon between the offset prevention layer, i.e., the upper layer and the elastic layer, i.e., the lower layer. That is, if the elastic layer, i.e., the lower layer does not have an oil absorbing property, oil accumulates at the interface between the elastic layer and the offset prevention layer, causing the peeling of the offset prevention layer at the interface.

Accordingly, it is preferred that the elastic layer, i.e., the lower layer absorbs oil to a degree not causing the peeling at the interface, and a change in the outer diameter of the fixing roller (a swelling phenomenon due to oil) is suppressed to a proper degree. As a result of intensive studies, it has become clear that a superior effect can be obtained when the oil absorption rate of the elastic layer is within the range of 5-20 wt %, as described above.

Although an explanation has been provided of the preferred embodiments of the present invention, the present invention is not limited to the above-described embodiments, but various changes and modifications are possible within the spirit and scope of the invention.

What is claimed is:

1. A fixing device comprising:

a fixing rotating member contacting an unfixed image and for grasping and conveying a recording material supporting an unfixed image; and coating means for coating release oil on said fixing rotating member, wherein said rotating member comprises an elastic rubber layer and an offset prevention layer provided on said elastic rubber layer, an oil absorption rate of said elastic rubber layer for said oil being 5-20 wt %, and an oil absorption rate of said offset prevention layer for said oil being 30-150 wt %.

2. A fixing device according to claim 1, wherein said release oil is silicone oil, and wherein said elastic layer and said offset prevention layer are made of silicone rubber.

3. A fixing device according to claim 2, wherein said elastic layer is made of HTV (high temperature vulcanization) silicone rubber, and said offset prevention layer is made of RTV (room temperature vulcanization) silicone rubber.

4. A fixing device according to claim 1, wherein said offset prevention layer is thinner than said elastic layer.

5. A fixing device according to claim 1, wherein said rotating member has the shape of a roller, and wherein said elastic layer is provided on a base material of the roller.

6. A fixing device according to claim 1, further comprising a pressure-contacting rotating member for pressure-contacting said fixing rotating member, and this pair of rotating members grasp and convey the recording material.

7. A fixing device according to claim 1, wherein said fixing rotatable member includes a heat source therewithin.

8. A fixing device according to claim 1, wherein said device is a full-color fixing unit for fixing with color-mixing the unfixed image composed of superimposed layers of toner.

9. A fixing device according to claim 1, wherein the thickness of said offset prevention layer is 0.05-0.4 mm.

10. A fixing device according to claim 1, wherein said elastic rubber layer is phenyl HTV silicone rubber.

* * * * *

UNITED STATES PATENT AND TRADEMARK OFFICE

CERTIFICATE OF CORRECTION

PATENT NO. : 5,049,943

DATED : September 17, 1991

INVENTOR(S) : MENJO, ET AL.

It is certified that error appears in the above-identified patent and that said Letters Patent is hereby corrected as shown below:

COLUMN 4

Line 4, "tranfer" should read --transfer--.
Line 11, "tranfer" should read --transfer--.
Line 34, "separation pawl 24," should read --separation pawl 20,--.

COLUMN 6

Line 40, delete "7".

COLUMN 9

Line 18, "elastic layers 7" should read --elastic layers 6--.

COLUMN 10

Line 21, "10,000-th sheet." should read "5,000-th sheet.--.

UNITED STATES PATENT AND TRADEMARK OFFICE
CERTIFICATE OF CORRECTION

PATENT NO. : 5,049,943

DATED : September 17, 1991

INVENTOR(S) : Menjo, et al

It is certified that error appears in the above-identified patent and that said Letters Patent is hereby corrected as shown below:

COLUMN 12

Line 28, "rotatable" should read --rotating--.

Signed and Sealed this

Sixth Day of July, 1993

*Attest:*

Michael K. Kirk

MICHAEL K. KIRK

*Attesting Officer*

*Acting Commissioner of Patents and Trademarks*